US006375098B1

(12) United States Patent
Fuseya et al.

(10) Patent No.: US 6,375,098 B1
(45) Date of Patent: Apr. 23, 2002

(54) INJECTION VALVE FOR THE FUEL INJECTION IN AN INTERNAL COMBUSTION ENGINE

(75) Inventors: Tsutomu Fuseya, Yokohama; Mahoro M. Fujita, Tokyo, both of (JP); Hermann Breitbach, Crauthem (LU); Russell Harmon Bosch, Gaines, MI (US)

(73) Assignees: Delphi Technologies, Inc., Troy, MI (US); Isuzu Motors, Ltd. (JP)

( * ) Notice: Subject to any disclaimer, the term of this patent is extended or adjusted under 35 U.S.C. 154(b) by 0 days.

(21) Appl. No.: 09/544,891

(22) Filed: Apr. 7, 2000

(51) Int. Cl.[7] ..... F02M 61/10
(52) U.S. Cl. ..... 239/533.11; 123/467
(58) Field of Search ..... 123/467, 456, 123/506, 514; 239/533.1–533.12; 251/214

(56) References Cited

U.S. PATENT DOCUMENTS

| | | | | | |
|---|---|---|---|---|---|
| 4,094,465 | A | * | 6/1978 | Bastenhof | 239/467 |
| 4,962,890 | A | * | 10/1990 | Shindo et al. | 239/533.4 |
| 5,205,492 | A | * | 4/1993 | Khinchuk | 239/533.4 |
| 5,458,293 | A | * | 10/1995 | Ganser | 239/533.8 |
| RE35,079 | E | * | 11/1995 | Sverdlin | 123/467 |
| 5,775,301 | A | * | 7/1998 | Ganser | 123/467 |
| 5,975,436 | A | * | 11/1999 | Reiter et al. | 239/585.1 |
| 6,102,302 | A | * | 8/2000 | Nishimura | 239/96 |
| 6,116,522 | A | * | 9/2000 | Kampichler | 239/533.2 |

FOREIGN PATENT DOCUMENTS

| | | |
|---|---|---|
| DE | 2707003 C2 | 8/1982 |
| DE | 4203343 C1 | 5/1993 |
| DE | 19614980 C1 | 9/1997 |

* cited by examiner

*Primary Examiner*—Henry C. Yuen
*Assistant Examiner*—Mahmoud Gimie
(74) *Attorney, Agent, or Firm*—Attorney John Vanophem

(57) ABSTRACT

The invention relates to an injection valve (10) for the fuel injection in a internal combustion engine, in particular in a diesel engine. The injection valve (10) has a holder body (20) in which a first passage (30) is formed. At the holder body (20) a nozzle body (40) of an injection nozzle (16) is secured in which a second passage (54) is formed which is connected to the first passage (30) and which together with the latter forms a fuel infeed line for the injection nozzle (16). Moreover, a closure mechanism (60) is provided for the closing off of the injection nozzle (16). A sleeve (74) serves for the sealing off of the connection point between the first and the second passage (30, 54).

4 Claims, 3 Drawing Sheets

INJECTION VALVE FOR THE FUEL INJECTION IN AN INTERNAL COMBUSTION ENGINE

TECHNICAL FIELD

The present invention relates to an injection valve for the fuel injection in an internal combustion engine, in particular in a diesel engine, comprising a holder body in which a first passage is formed, a nozzle body of an injection nozzle which is secured at the holder body and in which a second passage is formed which is connected to the first passage and which with the latter forms a fuel infeed line for the injection nozzle, a closure mechanism for the closing off of the injection nozzle, and a sealing means for the sealing off of the connection point between the first and the second passage. Furthermore, the invention relates to a sealing means for the sealing off of the connection point between the two passages.

BACKGROUND OF THE INVENTION

An injection nozzle of the initially named kind is used in internal combustion engines such as Otto engines or diesel engines in order to inject the fuel directly into the cylinder of the internal combustion engine or indirectly into an antechamber which is in connection with the cylinder. The injection valve should introduce an amount of fuel which is as precisely metered as possible at a predetermined time point into the cylinder or the antechamber respectively as a finely distributed mist. For this purpose the injection nozzle of the injection valve is closed off by a closure mechanism, for example a nozzle needle, which is mechanically prestressed and which opens the injection nozzle briefly for the fuel injection, with the emerging fuel being atomized by the injection nozzle. In order that a sufficient amount of fuel is injected and the fuel is atomized as finely as possible in spite of the short injection duration, the fuel is fed in to the injection valve with a pressure of 1400 bar and more in the known injection systems, such as for example the common rail injection system.

In order that the closure mechanism which is required for the closing off of the injection nozzle can be installed, the known injection valves are constructed of several parts. Thus the actual injection nozzle is secured together with the closure mechanism at a holder body. The fuel infeed takes place via a first passage which is formed in the holder body and which is connected to a second passage which is formed in the nozzle body of the injection nozzle. The second passage ends in a pressure chamber or in an outlet opening of the injection nozzle. In order to avoid a leakage of the fuel between the holder body and the nozzle body, the connection point between the two passages is sealed off by a sealing means, such as for example a sealing disc, or through correspondingly machined contact surfaces between the holder body and the nozzle body.

Since the fuel which is located in the fuel supply line is under very high pressure, as explained above, the sealing means at the connection point between the passages must be designed in such a manner that it can withstand very high stresses. For this reason in the known injection valves the sealing surfaces which are formed at the holder body and the nozzle body, at which the sealing means lies in contact, and the sealing means itself must be manufactured with very high manufacturing precision and high surface quality. Moreover, the sealing means which is arranged between the holder body and the nozzle body must be pressed together with such a high bias force that the connection point between the two passages does not leak in spite of the high pressures.

SUMMARY OF THE INVENTION

The object of the invention is to further develop an injection nozzle or, respectively, a sealing means of the initially named kind in such a manner that the connection point between the passages is sealed off in a simple manner and can also withstand high pressures.

This object is satisfied in the injection nozzle of the initially named kind in that a sleeve which protrudes at least into the first passage of the holder body or into the second passage of the nozzle body serves as a sealing means.

In the injection valve in accordance with the invention the sleeve, which protrudes into the passage, is pressed by the high pressure acting in the interior of the fuel infeed line against the inner wall of the passage and conforms to the surface of the latter, through which a leakage-free sealing off at the connection point between the passages is achieved. Moreover, lower demands need be placed on the manufacturing precision and the surface quality both during the manufacture of the passage and in the manufacture of the sleeve than in conventional injection valves since the sleeve, which conforms to the inner wall of the passage through the high pressure, compensates possible unevennesses or measurement deviations. Furthermore, the assembly of the injection valve is facilitated since the sleeve serves at the same time as a centering aid which simplifies the exact mutual orientation of the holder body and the nozzle body and the mutual alignment of the passages.

Advantageous further developments result from the description, from the drawings and from the respective subordinate claims.

Thus it is particularly advantageous when the sleeve has a section of smaller outer diameter. Through this design of the sleeve it is achieved that the sleeve is more strongly widened by the high pressure in the weakened section of smaller diameter than in the non-weakened sections of the sleeve and the sleeve conforms even better to the inner wall of the passage, with it bulging slightly outwardly in a convex manner at the same time. Through the convex deformation the transition between the section of smaller diameter and the adjacent, non-weakened section of the sleeve lays itself linear at the inner wall of the passage, through which a particularly good sealing action is achieved. In this the section of smaller diameter is preferably arranged in the region of the connection point between the passages in order to achieve as great a sealing action at the connection point as possible.

In a preferred embodiment of the injection valve the sleeve is formed as a separate component which is inserted into the fuel infeed line during the assembly of the injection valve and protrudes both into the first passage of the holder body and into the second passage of the nozzle body. This has the advantage that through the intentional selection of sleeves which differ in the design of the inner periphery the flow conditions of the fuel which flows through the fuel infeed line can be intentionally influenced.

In order that the sleeve has a secure hold in the fuel infeed line it can be pressed in into the passages so that a press fit is formed between the sleeve and the inner wall of the respective passage.

Alternatively, the sleeve can be formed integrally with the holder body or with the nozzle body. The sleeve then serves as a tubular prolongation of the first or of the second passage, respectively, which protrudes into the second passage of the nozzle body or the first passage of the holder body respectively after the assembly of the injection valve.

In this embodiment of the injection nozzle there is the advantage that in the assembly of the injection valve there are only few components to be assembled.

Furthermore, it is advantageous when at least one of the passages has at its end which faces the other passage a section with a larger inner diameter in which the sleeve is accommodated or pressed in, respectively. If the sleeve is designed as a separate component, as in the first of the two exemplary embodiments described above, the sleeve can rest on the offset which is formed in the passage, whereby on the one hand a moving about of the sleeve in the fuel infeed line is effectively prevented and, on the other hand, the sleeve is held by the offset in a predetermined position in the fuel infeed line.

The fuel infeed line can be designed as a simple passage which extends through the holder body and the nozzle body. On the other hand the passages which form the fuel infeed line can also be used as a reception for the closure mechanism of the injection nozzle. Thus the passages serve in a preferred embodiment of the injection nozzle not only as a fuel infeed line but also at the same time as a needle guide for a nozzle needle which acts as a closure mechanism by means of which the injection nozzle can be closed off. The nozzle needle is movable in the longitudinal direction of the needle guide between a rest position in which it closes off at least one injection hole in the nozzle body which is connected to the second passage and an opening position in which it at least partly opens the injection hole. The fuel is forwarded in this embodiment along the nozzle needle through the passages which serve as the needle guide and is ejected out of the injection hole which is formed at the end of the second passage. Through the connection of the two passages which serve as the needle guide to the sleeve it is also achieved that the longitudinal axes of the passages extend in a definite manner relative to one another and the nozzle needle bends at most slightly transversely to its longitudinal direction during its movements in the needle guide.

In order to influence the flow behavior of the fuel which flows through the fuel infeed line which serves as a needle guide, it is furthermore possible to use a nozzle needle which has a cross-sectional shape which varies in its dimensions over its length. Thus the nozzle needle preferably has at least one section of larger diameter which reduces the cross-sectional area through which the fuel flows, which is bounded by the inner wall of the fuel infeed line and the jacket surface of the nozzle needle, and which acts as a restrictor which increases the flow resistance.

The section of larger diameter is preferably formed at the nozzle needle with a spacing from the needle tip so that the cross-sectional area of the fuel infeed line through which the fuel flows is larger between the needle tip and the section of larger diameter of the nozzle needle than the cross-sectional area of the fuel infeed line which is flowed through in the region of the section of larger diameter of the nozzle needle. Through this it is achieved that the fuel has a lower flow velocity in the longitudinal section of the fuel infeed line in which the needle tip is located than in the longitudinal section of the fuel infeed line in which the section of the nozzle needle of larger diameter is located. This has the result that the amount of fuel which is located near the needle tip when the injection valve is opened flows off more rapidly as a result of the lower flow resistance caused by the lower flow velocity in this longitudinal section than the fuel which flows after it through the longitudinal section of the fuel infeed line which is narrowed by the section of larger diameter of the nozzle needle, which fuel admittedly has a higher flow velocity, but however must also overcome a greater flow resistance. Through this a pressure difference arises between the two longitudinal sections of the fuel infeed line, with the pressure being greater in the longitudinal section of the fuel infeed line in which the section of the nozzle needle of larger diameter is located. The higher pressure assists in turn the closure movement of the nozzle needle into its rest position. In order to amplify this effect it is furthermore proposed to form at the nozzle needle between the needle tip and the section of larger diameter a section, the diameter of which is smaller than the average diameter of the nozzle needle.

In the same way the flow behavior of the fuel in the fuel infeed line can also be influenced through the cooperation of the sleeve with the jacket surface of the nozzle needle so that the sleeve forms a restrictor point with the nozzle needle when the nozzle needle is moved into its opening position.

In a preferred further development of the above described injection valve with nozzle needle, the nozzle needle is prestressed into its rest position by at least one spring element which is provided in the first passage of the holder body, with the spring element effecting or assisting respectively the closure movement of the nozzle needle.

Furthermore, it is advantageous if the inner periphery of the sleeve, which is deformed by the high pressure, together with the outer periphery of the nozzle needle forms a space which extends in ring shape transversely to the longitudinal direction of the nozzle needle and through which the fuel flows through. Through a corresponding design of the cross-sectional shape of the ring-shaped space in the longitudinal direction of the nozzle needle the flow behavior of the fuel can be intentionally influenced. Thus it is possible to use a sleeve which has an inner periphery which varies in its dimensions over its length and which together with the preferably cylindrical outer periphery of the nozzle needle forms a restrictor point.

Since a definite position between the holder body and the nozzle body is already predetermined by the sleeve, only a further rotational securing, for example in the form of a centering pin, is now required by means of which the position of the nozzle body relative to the holder body is fixed.

In an alternative embodiment a feather key is preferably used as a rotational securing. For this purpose a groove into which the rotational securing can be laid in is formed in each case at the holder body and at the nozzle body. As soon as the holder body is mounted at the nozzle body the two grooves are aligned with respect to one another in such a manner through a rotation of the holder body relative to the nozzle body that the two grooves, which are open at the mutually facing ends, align with one another. Then the rotational securing is inserted into the grooves.

The sleeve serves in this embodiment additionally as a centering aid, which on the one hand facilitates the mutual alignment of the grooves, and on the other hand together with the rotational securing prescribes a definite position of the nozzle body relative to the holder body in order that the injection holes which are formed at the nozzle body take on their predetermined angular positions. At the same time it is achieved through the cooperation of the sleeve with the rotational securing, which is accommodated in the grooves, that the end sides of the holder body and of the nozzle body which mutually lie in contact lie more uniformly in contact than in known rotational securings for injection valves, whereby the sealing action between the end sides is further increased.

It is particularly advantageous when the grooves are formed in each case at the jacket surfaces of the holder body and the nozzle body and extend in the axial direction of the injection valve, whereas at the same time a nozzle tightening nut which secures the nozzle body at the holder body secures the rotational securing which is accommodated in the grooves against a dropping out. On the one hand such grooves can be produced without a great effort, and on the other hand through the axial course of the grooves at the jacket surfaces both the nozzle body and the holder body can be reduced in their dimensions transversely to the longitudinal direction of the injection nozzle with the strength remaining the same. If the dimensions of the nozzle body and the holder body are retained unchanged, on the other hand, the strength of the injection valve is increased.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
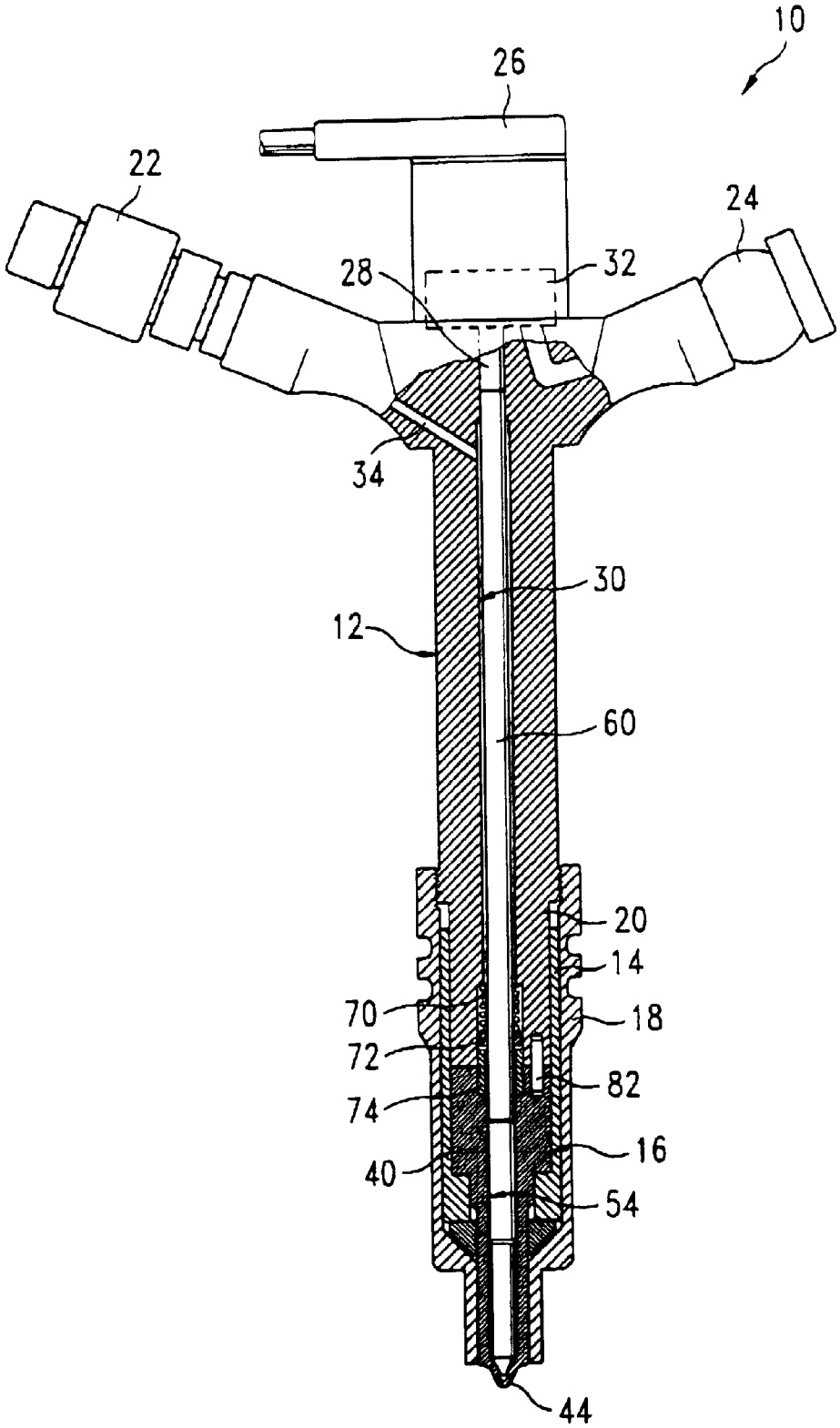
FIG. 1 is a partly sectioned side view of an injection valve in accordance with the invention for the fuel injection in a diesel engine.

FIG. 1 shows an injection valve 10 for a common rail injection system of a diesel engine. The injection valve 10 has a nozzle holder 12 and an injection nozzle 16 which is secured to the latter by a nozzle tightening nut 14. The injection nozzle 16 is held together with the nozzle holder 12 and the nozzle tightening nut 14 in a reception sleeve 18 by means of which the injection valve 10 is secured in the diesel engine.

The nozzle holder 12 has an approximately cylindrical holder body 20, near the upper end of which a fuel connector 22, which is illustrated at the left in FIG. 1, projects upwardly at an inclination by an angle and can be connected to a fuel line (not illustrated). Approximately at the same height at the opposite side of the holder body 20, which is illustrated at the right in FIG. 1, a leakage fuel connector 24 is provided which likewise extends upwardly at an inclination by an angle and which can be connected to a recirculation line (not illustrated). Furthermore, at the end side of the holder body 20 which is illustrated above in FIG. 1 a magnetic valve 26 is secured, which is connected to an electronic injection control system (not illustrated) of the diesel engine and by means of which an operating element 28 which is provided at the holder body 20 and the purpose of which will be explained later can be actuated with the help of a hydraulic amplification (not illustrated).

A passage bore 30 starting from the end side of the holder body 20 which is provided with the magnetic valve 26 up to its lower end side which faces the injection nozzle 16 is formed in the holder body 20 extending in its longitudinal direction and arranged concentrically. At the end side which is provided with the magnetic valve 26 a sealing arrangement 32 (illustrated in broken lines) is secured which seals off the passage bore 30 to the outside and at the same time enables an active contact between the operating element 28 and the magnetic valve 26. The sealing arrangement 32 is furthermore connected to the leakage fuel connector 24, through which fuel which possibly escapes through the sealing arrangement 32 can be for example returned into the fuel tank. Furthermore, the passage bore 30 is in connection with the fuel connector 22 via a supply channel 34. The passage bore 30 is stepped and has a section 36 of smaller outer diameter which starts from the upper end side and at which a section 38 of larger inner diameter adjoins, which ends at the lower end side of the holder body 20, as FIG. 2 shows.

Figure 2:
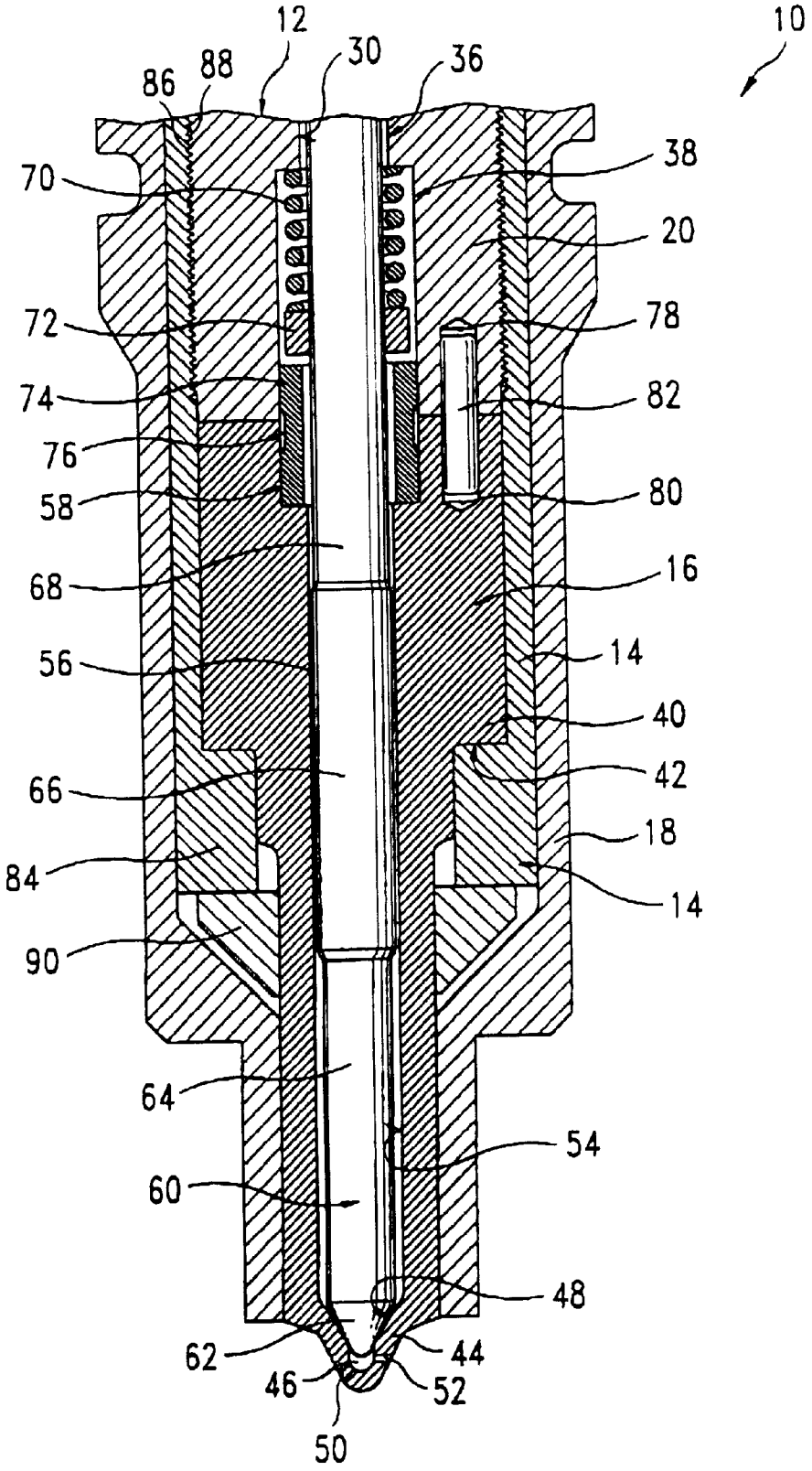
FIG. 2 is an enlarged illustration of a detail of the injection valve in accordance with FIG. 1.

As is further shown in FIG. 2, the injection nozzle 16 is secured with the help of the nozzle tightening nut 14 at the lower end side of the holder body 20. The injection nozzle 16 has a nozzle body 40 with an offset 42 which merges into a nozzle tip 44. The nozzle tip 44 has a seat hole-type nozzle 46 with a conical sealing surface 48 and two injection holes 50 and 52 which atomize the fuel which emerges from the injection nozzle 16. The conical sealing surface 48 of the seat hole-type nozzle 46 merges into a longitudinal bore 54 which extends in the longitudinal direction of the nozzle body 40, which extends concentrically to the nozzle body 40 and which aligns with the passage bore 30 of the holder body 20. The longitudinal bore 54 also has a section 56 of smaller diameter which starts from the conical sealing surface 48 of the seat hole-type nozzle 46 and merges into a section 58 of larger diameter. The dimensions of the two sections 56 and 58 of the longitudinal bore 54 transverse to their longitudinal direction correspond in the exemplary embodiment illustrated in FIGS. 1 and 2 to the dimensions of the sections 36 and 38 of the passage bore 30. On the other hand it is also possible that the sections 56 and 58 differ in their dimensions from the dimensions of the sections 36 and 38.

A nozzle needle 60, the needle tip 62 of which is designed as a sealing cone by means of which the nozzle needle 60 is supported at the conical sealing surface 48 of the seat hole-type nozzle 46 is introduced into the passage bore 30 and the longitudinal bore 54. In this the conical sealing surface 48 of the seat hole-type nozzle 46 has a somewhat larger opening angle than the sealing cone of the needle tip 62. The other end of the nozzle needle 60 lies in contact under a bias force at the operating element 28, which is pressed through the hydraulic amplification by the magnetic valve 26 in the direction of the seat hole-type nozzle 46. The dimensions of the cross-sectional shape of the nozzle needle 60 vary in its longitudinal direction so that starting from the needle tip 62 a front section 64 of smaller outer diameter is formed at which a restrictor section 66 of larger outer diameter adjoins which can also serve at the same time as a guide element for the nozzle needle 60 in the longitudinal bore 60. The restrictor section 66 merges in turn into a second section 68, the outer diameter of which is greater than that of the first section 64, but is however smaller than that of the restrictor section 66. In a modified embodiment the outer diameter of the second section 68 can also correspond to the outer diameter of the first section 64.

A compression spring 70 which is pushed on onto the nozzle needle 60 is accommodated in the section 38 of the passage bore 30 of larger inner diameter. The compression spring 70 rests with its one end on the offset in the passage bore 30 which is formed by the step. The other end of the compression spring 70 lies under a bias force in contact at a support ring 72 which is pushed onto the nozzle needle 60 and is secured to the latter for example through shrinking. Through the force of the compression spring 70 the nozzle needle 60 is held in a rest position in which the nozzle needle 60 is pressed with its needle tip 62, which is formed as a sealing cone, against the conical sealing surface 48 of the seat hole-type nozzle 46 and closes off the latter in a fluidtight manner. For the opening of the injection valve 10 the nozzle needle 60 can be moved against the force of the compression spring 70 by the pressurized fuel into an opening position in which the seat hole-type nozzle 46 is opened and the fuel can emerge unhindered through the injection holes 50 and 52, as will be explained later.

A sleeve 74 is inserted at the connection point between the section 36 of the passage bore 30 and the section 58 of the longitudinal bore 54. The end sections of the sleeve 74 are pressed in into the two sections 38 and 58 of the bores 30 and 54, with a press fit being formed between the respective end section of the sleeve 74 and the section 38 or 54 respectively which is associated with the latter. Between the two end sections the sleeve 74 has at its jacket surface a circumferential, flat ring groove 76 which is arranged approximately at the height of the connection point between the two bores 30 and 54. The sleeve 74 serves on the one hand as a centering aid which facilitates the assembly of the injection valve 10 and on the other hand as a sealing means between the connection point of the two bores 30 and 54, as will be explained later.

Moreover, a first blind hole 78 is formed in the holder body 20 to the side of the concentrically extending passage bore 30 and aligns with a second blind hole 80 which is formed at the nozzle body 40. A centering pin 82 which prevents a rotating of the nozzle body 40 relative to the holder body 20 is inserted into the blind holes 78 and 80 in order that the injection valve 10 can be mounted with its injection holes 50, 52 in a definite installation position.

Onto the nozzle body 40 of the injection nozzle 18 is pushed the nozzle tightening nut 14, which is formed as a sleeve, which is supported with an inwardly projecting collar 84 at the offset 42 of the nozzle body 40 and which through an inner thread 86 is in engagement with an outer thread 88 formed at the holder body 20. The nozzle tightening nut 14 is in turn secured by a holding ring 90 which is secured at the nozzle tip 44 of the nozzle body 40 for example through shrink fitting. The nozzle tightening nut 14 is introduced into the reception sleeve 18, which is in turn screwed together with the holder body 20, and with which the injection valve 10 is secured in a predetermined position at the engine block or the cylinder head of the diesel engine.

The injection valve 10 in accordance with the invention is, as already discussed above, used in particular in a so-called common rail injection system for diesel engines. In this injection system fuel is placed under high pressure by a central fuel pump in a common distributor rail. The average pressure which is thereby produced in the common distributor rail lies approximately in a range of up to 1400 bar and more. A plurality of injection valves 10 in accordance with the invention are connected to the common distributor rail.

The fuel is conducted via the fuel connector 22 into the passage bore 30 and along the nozzle needle 60 into the longitudinal bore 54 of the respective injection valve 10. As a result of the high pressure which acts in the interior of the passage bore 30 and longitudinal bore 54 which form the fuel infeed line of the injection valve 10, the sleeve 74 is widened at the connection point between the two bores 30 and 54 from the inside and conforms to the inner wall of the passage bore 30 and the longitudinal bore 54. In this the sleeve 74 is particularly strongly widened at the region which is weakened by the flat ring groove 76 and bulges outwardly in a convex manner. Through the convex deformation the transition between the ring groove 76 and the respective end section of the sleeve 74 lies in contact at the inner wall of the respective bore 30 or 54, respectively, in the shape of a line, through which a particularly good sealing action is achieved and in particular the connection point between the two bores 30 and 54 is well sealed off.

As a result of the different opening angles between the sealing cone of the needle tip 62 and the conical sealing surface 48 of the seat hole-type nozzle 46 a circumferential gap between the needle tip 62 and the conical sealing surface 48 is formed, at which the pressure which acts in the fuel can act. The nozzle needle 60 would normally be moved against the force of the compression spring 70 into its opening position by this high pressure, which acts in the gap between the needle tip 62 and the conical sealing surface 48. This is however prevented by the magnetic valve 26, which by means of the hydraulic amplification holds the operating element 28 and thus the nozzle needle 60 in its rest position in which it closes off the seat hole-type nozzle 46. Only when the injection valve 10 is to inject fuel the magnetic valve 26 is actuated by the electronic injection control system in such a manner that it releases the nozzle needle 60. As soon as the nozzle needle 60 is released it is moved into the opening position by the pressurized fuel and opens the seat hole-type nozzle 46 so that the fuel can flow out through the injection holes 50 and 52.

In this the fuel which is located in the longitudinal section of the longitudinal bore 54 in which the first section 64 of the nozzle needle 60 of smaller diameter is arranged flows with a high flow velocity out of the longitudinal bore 54. At the same time the fuel which flows after it is restricted by the restrictor section 66 which is formed at the nozzle needle 60 and which is arranged directly after the sleeve 74 when viewed in the flow direction. The sleeve 74, the inner diameter of which is somewhat larger than the inner diameter of the section 58 of the longitudinal bore 54, thus acts together with the restrictor section 66 of the nozzle needle 60 as a restrictor unit. In an alternative embodiment a sleeve 74 is used which has an inner periphery which varies in its dimensions over its length and which together with the preferably cylindrical outer periphery of the nozzle needle 60 forms a restrictor point.

Through the restricting of the after-flowing fuel an excess pressure arises in the region of the longitudinal bore 54 in which the restrictor section 66 is located in comparison with the longitudinal section of the longitudinal bore 54 which follows when viewed in the flow direction. This excess pressure acts on the nozzle needle 60 and assists its closure movement into the rest position as soon as the magnetic valve 26 is to close the injection valve 10 by means of the operating element 28.

Figure 3:
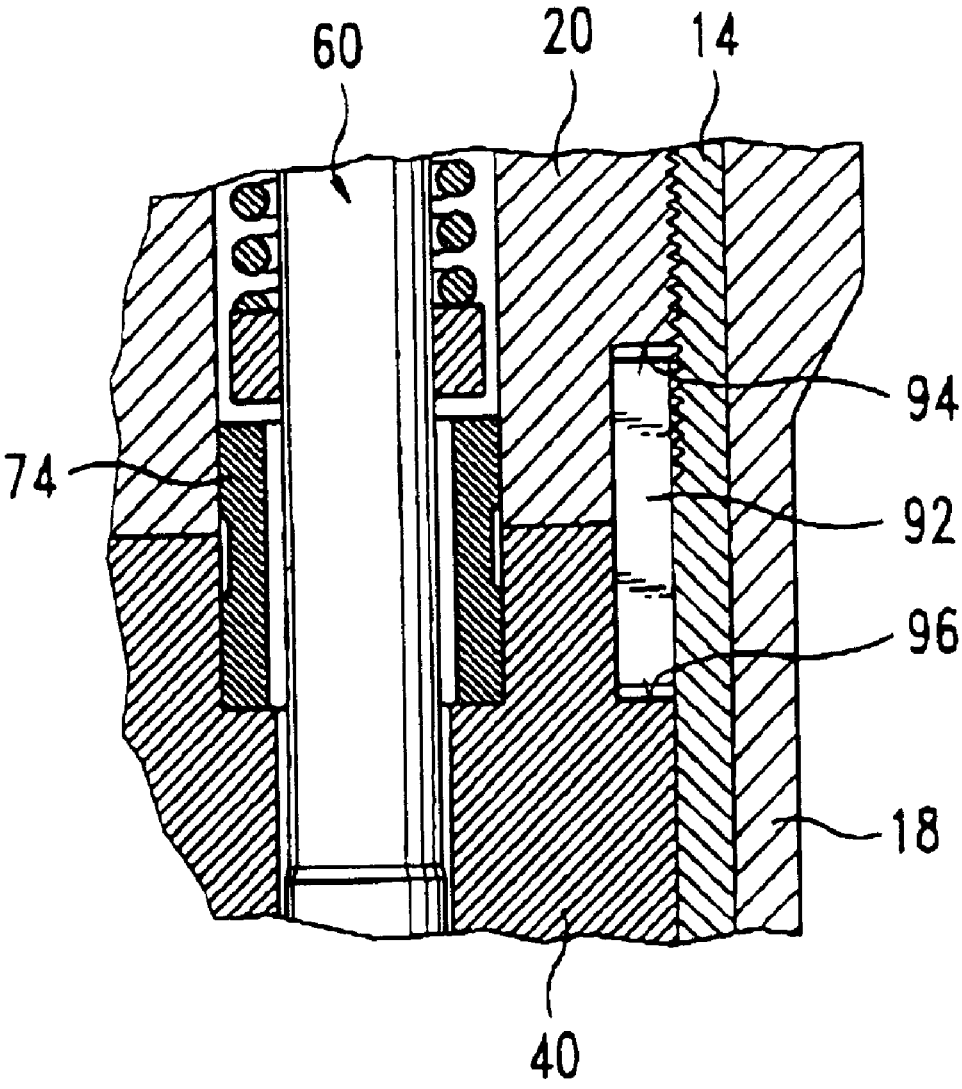
FIG. 3 is a detail of a modified embodiment of the injection nozzle in accordance with FIG. 1.

In a modified embodiment of the injection valve 10, of which a detail is illustrated in FIG. 3, a feather key 92 is used instead of the centering pin 82 as a rotational securing. For this purpose, at the jacket surface of the holder body 20 and at the jacket surface of the nozzle body 40 an axial groove 94 and 96, respectively, is in each case formed which extends parallel to the passage bores 30 and 32 and which ends at the end side of the holder body 20 or the nozzle body 40, respectively. As soon as the holder body 20 is mounted at the nozzle body 40 the two open grooves 94 and 96, which are open at the mutually facing ends, are aligned with respect to one another in such a manner through a rotation of the holder body 20 relative to the nozzle body 40 that the two grooves 94 and 96 align with one another and form a continues reception. Then the feather key 92 is inserted into the mutually aligned grooves 94 and 96. In this the nozzle tightening nut 14, which is screwed on after the insertion of the feather key 92, prevents a falling out of the feather key 92 out of the grooves 94 and 96.

The sleeve 74 serves in this embodiment in addition as a centering aid which, on the one hand, facilitates the mutual aligning of the grooves 94 and 96 and, on the other hand, prescribes together with the feather key 92 a definite position of the nozzle body 40 relative to the holder body 20 in order that the injection holes 50 and 52 which are formed at the nozzle body 40 take in their predetermined angular positions. At the same time it is achieved through the cooperation of the sleeve 74 with the feather key 92 which is accommodated in the grooves 94 and 96 that the end sides of the holder body 20 and of the nozzle body 40 lie uniformly in contact at one another, through which the sealing action between the end sides in further increased.

What is claimed is:

1. An injection valve for fuel injection in an internal combustion engine, in particular in a diesel engine, comprising a holder body (20) in which a first passage (30) is formed, a nozzle body (40) of an injection nozzle (16) which is secured at the holder body (20) and in which a second passage (54) is formed and which with the first passage forms a fuel infeed for the injection nozzle (16), a closure mechanism (60) for the closing off of the injection nozzle (16), and a sealing means (74) for selectively sealing in a fluid tight manner at least one of the first and the second passage (30, 54), characterized in that a sleeve (74) disposed within the fuel infeed and which protrudes into the first passage (30) of the holder body (20) and into the second passage (54) of the nozzle body (40), the sleeve (74) having a section (76) of smaller outer diameter, the section (76) of smaller outer diameter is formed between two sections of larger outer diameter, and in that the sleeve (74) is inserted in the fuel infeed line in such a manner that the section (76) of smaller diameter is located in at least one of the passages (30, 54), said section (76) of smaller diameter being deformed by fuel pressure convexly into engagement with and conforming to the inner wall of at least one of the fuel passages (30, 54).

2. Injection valve in accordance with claim 1, characterized in that the sleeve (74) is pressed in into at least one of the passages (30, 54).

3. Sealing means for the sealing off of two passages (30, 54) from each other which are provided in a holder body (20) and a nozzle body (40) of an injection valve (10), characterized in that the sealing means is a sleeve (74) inserted into at least one of the passages (30, 54) and which protrudes into the other, the sleeve (74) including a section (76) of smaller outer diameter which is formed between two sections of larger outer diameter, the sleeve (74) being arranged in such a manner that the section (76) of smaller outer diameter is located in at least one of the passages (30, 54).

4. Sealing means in accordance with claim 3 characterized in that the two passages (30, 54) align with one another and the fuel infeed line which is formed by the passages (30, 54) serves at the same time as a needle guide for a nozzle needle (60) with which the injection nozzle (16) of the injection valve (10) can be closed off, and in that the inner periphery of the sleeve (74) together with the outer periphery of the nozzle needle (60) forms a restrictor point in the fuel infeed line.

* * * * *